United States Patent [19]

Gill et al.

[11] 3,990,147

[45] Nov. 9, 1976

[54] EDGE SCRAPING TOOL

[75] Inventors: John R. Gill, Hatboro; Richard S. Massarella, Abington, both of Pa.

[73] Assignee: Rohm and Haas Company, Philadelphia, Pa.

[22] Filed: Oct. 14, 1975

[21] Appl. No.: 622,340

[52] U.S. Cl. ..... 30/172; 30/293

[51] Int. Cl.[2] ..... B27G 17/02

[58] Field of Search ..... 30/169, 172, 287, 294, 30/293; 15/236 R

[56] References Cited

UNITED STATES PATENTS

| | | | |
|---|---|---|---|
| 3,371,417 | 3/1968 | Leibow | 30/293 |
| 3,732,619 | 5/1973 | Grueber | 30/287 |
| 3,762,046 | 10/1973 | Kolomick | 30/172 |
| 3,766,649 | 10/1973 | Winbauer | 30/172 |

*Primary Examiner*—Al Lawrence Smith
*Assistant Examiner*—J. C. Peters
*Attorney, Agent, or Firm*—Michael B. Fein

[57] ABSTRACT

A tool for scraping an edge of a flat article, the tool comprising a first flat surface defining a first plane, a second flat surface defining a second plane at right angles to the first plane, and a cutting blade mounted at or near one end of the second flat surface, the plane of the blade being perpendicular to both the first plane and the second plane.

8 Claims, 9 Drawing Figures

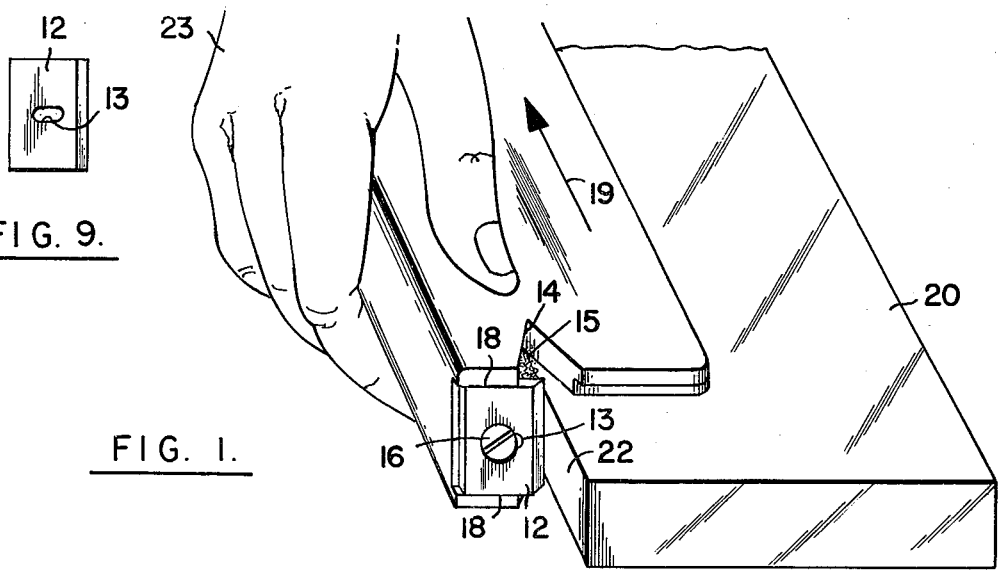
FIG. 9.
FIG. 1.
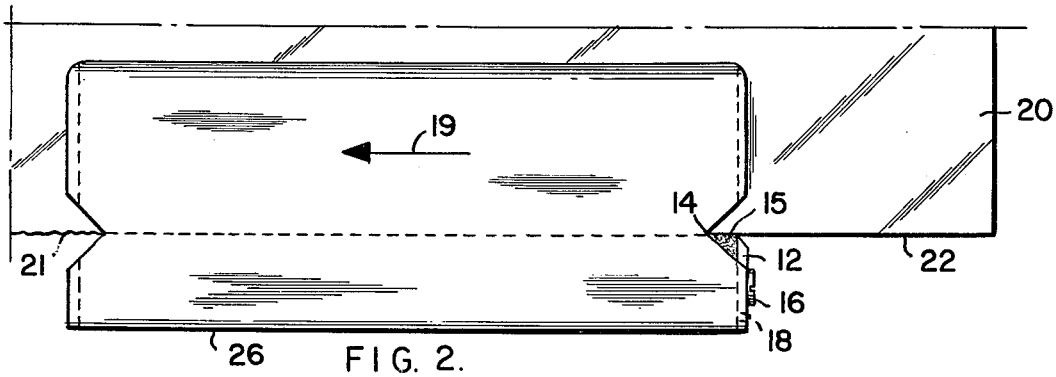
FIG. 2.
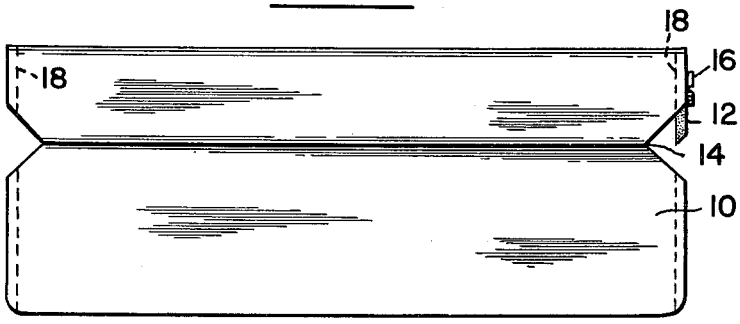
FIG. 3.
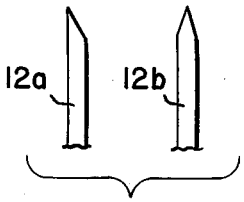
FIG. 8.
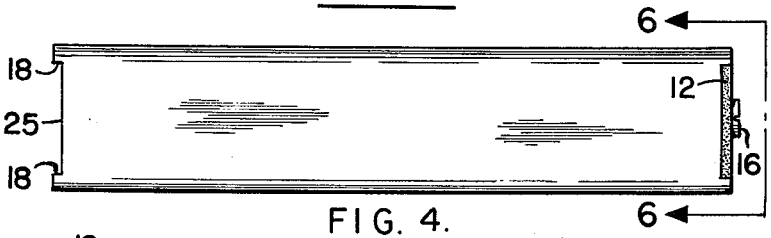
FIG. 4.
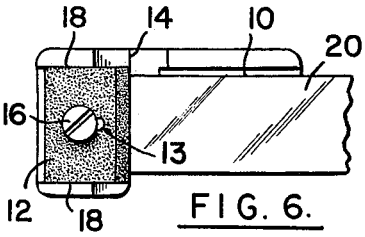
FIG. 6.
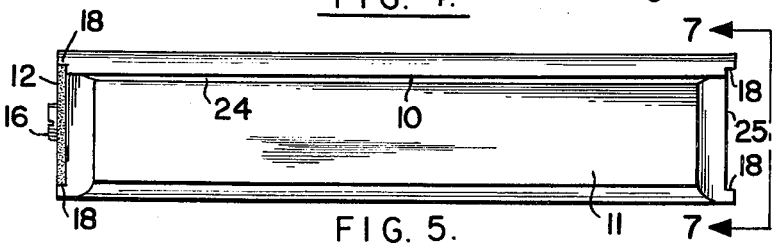
FIG. 5.
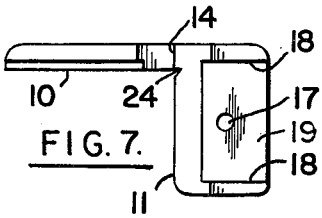
FIG. 7.

EDGE SCRAPING TOOL

BACKGROUND OF THE INVENTION

1. Field of the Invention

This invention relates to scraping tools and methods for using them.

2. Description of the Prior Art

In fabricating acrylic plastic sheet, the sheet is generally sawed, scraped, then buffed. If one does not scrape or sand after sawing, blade marks are left which interfere with proper cementing and also show up when the edge is buffed. An alternative method to sawing is use of a scribe cut, but this results in an edge which is not square, i.e., a fractured edge, and this type of edge also interferes with proper cementing. Prior scraping methods in general use comprised a sharpened hacksaw blade or file blade or any other hardened piece of steel held by hand and used to scrape the edge of the material. The problems with such methods were that the edge produced was not straight, parallel, squared off, or controlled, and the method produced a wobbley, lumpy, bumpy edge which sometimes caused problems in cementing.

The prior patents known to applicants in the field of scraping tools are U.S. Pat. Nos. 3,751,084; 3,552,014; 2,106,055; 1,327,155; 1,927,202; and 462,455. None of the references or prior art known to applicants meets the object achieved by the present invention.

SUMMARY OF THE INVENTION

It is an object of the present invention to provide a tool which can be easily used to achieve a straight parallel, squared off, controlled smooth edge on a flat material. A further object is to provide a method of scraping the edge of a flat material so as to produce a squared off straight, controlled edge surface. These objects, and others as will become apparent from the following description, are achieved by the present invention which comprises a tool for scraping an edge of a flat article, said tool comprising a first flat surface defining a first plane, a second flat surface defining a second plane at right angles to said first plane, and a cutting blade mounted at or near one end of the second flat surface, the plane of said blade being perpendicular to both said first plane and said second plane.

Although the following disclosure describes one specific embodiment of the invention in great detail, various modifications, alterations, and improvements may be made by those skilled in the art without departing from the spirit and scope of the invention as defined by the claims at the end hereof.

BRIEF DESCRIPTION OF THE DRAWING

FIG. 1 is a front elevational view of a tool being used to scrape an edge of a flat sheet.

FIG. 2 is a top plan view of the tool.

FIG. 3 is a bottom plan view of the tool.

FIG. 4 is a back plan view of the tool.

FIG. 5 is a front plan view of the tool.

FIG. 6 is an end view through 6—6 of FIG. 4.

FIG. 7 is an end view through 7—7 of FIG. 5.

FIG. 8 is a cross sectional end view of two different cutting blade embodiments.

FIG. 9 is a plan view of a cutting blade.

DESCRIPTION OF THE PREFERRED EMBODIMENTS

The edge scraping tool 26 of the invention is shown in one embodiment in FIG. 1 wherein a flat plastic sheet 20 is shown being scraped by the human hand 23 moving the tool 26 in direction 19 producing shavings 15 which freely exit through chip clearance notch 14 producing a smooth right angle edge 22 free of saw marks. Cutting blade 12 is shown mounted on one end of the tool (the forward end in FIG. 1) by means of screw 16. The cutting blade 12 has an elongated hole 13 shown in greater detail in FIG. 9 which allows for adjustment of the height of the cutting blade. The height of the cutting blade 12 is usually from just above level with second flat surface 11 to ⅛ inch above the surface. The preferred blade height is 1/10 inch.

The edge scraping tool has a first flat surface 10 defining a first plane and a second flat surface 11 defining a second plane at right angle to the first plane and a cutting blade 12 mounted at or near at least one end 19 of said second flat surface, the plane of the cutting blade being perpendicular to both the first and second plane. The screw 16 fits in threaded hole 17 so as to adjustably secure the blade on indented surface 19. Because of grooves 18, the cutting blade is secured firmly in its proper position so that the finished edge is at a right angle to one surface of the flat article being scraped.

In FIG. 2, the unfinished edge 21 of plastic sheet 20 is shown being scraped by the tool 26 to produce a smooth finished edge 22. In FIGS. 3 and 5 are shown clearance notch 24 which functions as clearance for paper overhang. Frequently, the edge finishing operation is conducted with the protective masking paper of the flat plastic sheet still in place so as to avoid scratching the sheet before it is finally installed. In FIG. 4 is shown alternative blade mounting position 25 which can be used when switching from a left-handed operator to a right-handed operator. Alternatively, mounting position 25 can also be used to mount a second cutting blade for certain embodiments wherein two blades are desired. FIG. 8 shows two types of cutting blades **12*a* and 12*b*. The cutting blade is preferably a flat rectangular piece of tool steel or other metal cutting material such as carbide steel which is ground on the long side of the rectangle at an angle of about 25° to 65°. This creates a right triangle in section which becomes the cutting or scraping edge of the tool, as in 12*a*. A similar cutting edge 12*b* could be made by shaping both edges of one long side of the rectangular blade to form an isosceles triangle which becomes cutting or scraping edge. At the position where the center lines of the width and length of the rectangular blade intersect, there is preferably an elongated hole 13 which is 2½ times as long as it is wide. This elongated hole allows for adjusting of the blade in such a manner as to bring the scraping edge closer or farther away from the material to be scraped. The amount of movement is determined by the length of the hole. An oval head fillister type of screw 16 is used to clamp and lock the cutting blade 12** in a specific position for scraping.

The edge scraping tool 26 can be either pulled in direction 19 or pushed in the opposite direction or pulled and pushed alternatively. The first flat surface is held against a surface of flat material to be scraped, and the second flat surface is held against the edge. The edge scraping tool rides on the flat article in a controlled fashion and the operator maintains pressure in both directions.

The tool is preferably constructed of extruded aluminum and milled or machined. The cutting blade 12 alternatively can be hollow ground.

The edge scraping tool can be used to scrape a very smooth edge upon various types of material, for example, acrylic plastic sheet, but can also be used in a variety of other scraping operations such as other plastic sheet, the edges of snow skis which are usually aluminum, brass sheet, Formica sheet, etc. In the case of metal sheet, it is preferred that the cutting blade be of carbide steel which is sufficient for scraping metals such as aluminum. Other materials can be scraped as long as the material being scraped is softer than the cutting blade.

What is claimed is:

1. A tool for scraping an edge of a flat article, said tool comprising a first flat surface defining a first plane, a second flat surface defining a second plane at right angles to said first plane, said second flat surface adapted to glide along said edge of said flat article, and a cutting blade mounted at or near at least one end of said second flat surface, said cutting blade having a cutting edge parallel to and slightly above said second plane and perpendicular to said first plane, the plane of said blade being perpendicular to both said first plane and said second plane.

2. The tool of claim 1, wherein said cutting blade has an elongated hole for adjustably mounting.

3. The tool of claim 1, having a chip clearance relief notch between the cutting edge of said blade and said second flat surface adapted to permit flow of shavings produced from scraping away from said blade and said second flat surface.

4. The tool of claim 1, further including a relief notch at the juncture of said first and second flat surfaces.

5. The tool of claim 1, adapted in size and shape to be used by a human hand.

6. The tool of claim 1, having a replaceable cutting blade.

7. The tool of claim 1, having alternative cutting blade mounting positions at or near both ends of said second flat surface.

8. The tool of claim 1, wherein the cutting blade has an elongated hole for adjustably mounting, the tool has a chip clearing relief notch between the cutting edge of said blade and said flat surface adapted to permit flow of shavings produced from scraping away from said blade and said second flat surface, the tool further includes a relief notch at the juncture of said first and second flat surfaces, the tool being adapted in shape to be used by a human hand, the tool having a replaceable cutting blade and two alternative cutting blade mounting positions at or near both ends of the second flat surface, further including means for maintaining the edge of the cutting blade perpendicular to the first plane and slightly above the second plane.

* * * * *